US011759809B2

(12) United States Patent
Moretti

(10) Patent No.: US 11,759,809 B2
(45) Date of Patent: Sep. 19, 2023

(54) FLUID SUBSTANCE DISPENSING DEVICE

(71) Applicant: Lumson S.p.A., Capergnanica (IT)

(72) Inventor: Matteo Moretti, Crema (IT)

(73) Assignee: LUMSON S.P.A., Capergnanica (IT)

( * ) Notice: Subject to any disclaimer, the term of this patent is extended or adjusted under 35 U.S.C. 154(b) by 0 days.

(21) Appl. No.: 17/529,434

(22) Filed: Nov. 18, 2021

(65) Prior Publication Data

US 2022/0152639 A1 May 19, 2022

(30) Foreign Application Priority Data

Nov. 18, 2020 (IT) ..... 102020000027618

(51) Int. Cl.

| | |
|---|---|
| ***B05B 11/00*** | (2023.01) |
| ***B65B 7/28*** | (2006.01) |
| ***B65D 1/12*** | (2006.01) |
| ***B65D 25/40*** | (2006.01) |
| ***B65D 33/14*** | (2006.01) |
| ***B65D 41/00*** | (2006.01) |
| ***B65D 81/20*** | (2006.01) |
| ***B65D 83/00*** | (2006.01) |

(52) U.S. Cl.

CPC ..... *B05B 11/0038* (2018.08); *B65B 7/2842* (2013.01); *B65D 1/12* (2013.01); *B65D 25/40* (2013.01); *B65D 33/14* (2013.01); *B65D 41/005* (2013.01); *B65D 81/20* (2013.01); *B65D 83/0055* (2013.01); *B65D 2251/0015* (2013.01); *B65D 2251/0087* (2013.01); *B65D 2251/0093* (2013.01); *B65D 2525/282* (2013.01)

(58) Field of Classification Search

CPC ..... B05B 11/0038; B05B 11/026; B05B 11/1047; B65D 25/40

See application file for complete search history.

(56) References Cited

U.S. PATENT DOCUMENTS

| | | | | | |
|---|---|---|---|---|---|
| 4,008,830 | A | * | 2/1977 | Meshberg | B65D 83/0055 222/95 |
| 4,457,454 | A | * | 7/1984 | Meshberg | B05B 11/1066 222/207 |
| 4,457,455 | A | * | 7/1984 | Meshberg | B05B 11/1056 222/105 |
| 4,796,786 | A | * | 1/1989 | Czech | B05B 11/1074 222/327 |
| 5,004,123 | A | * | 4/1991 | Stoody | B05B 11/026 222/105 |

(Continued)

FOREIGN PATENT DOCUMENTS

| | | | |
|---|---|---|---|
| DE | 9211396 | U1 | 12/1992 |
| EP | 0447997 | A2 | 9/1991 |
| JP | H0619860 | A | 1/1994 |

*Primary Examiner* — Vishal Pancholi
*Assistant Examiner* — Randall A Gruby
(74) *Attorney, Agent, or Firm* — Dickinson Wright PLLC; Andrew D. Dorisio

(57) ABSTRACT

A device for dispensing a fluid substance (F) comprising a manually operated pump (2) coupled to a deformable bag (3), the deformable bag being housed inside a container (4); the container is formed of a collar (5) made of plastic coupled to a tubular element (6) formed from a paper- or cardboard-based material, the tubular element featuring a bottom (7), the collar (5) featuring ribs (N) made on a surface thereof which comes into contact with an internal wall of the tubular element (6).

10 Claims, 3 Drawing Sheets

(56) References Cited

U.S. PATENT DOCUMENTS 5,224,627 A * 7/1993 Weag ..... B05B 11/0054 239/600
5,292,033 A * 3/1994 Gueret ..... B05B 11/028 222/105
5,351,862 A * 10/1994 Weag ..... B05B 11/028 222/327
5,411,176 A * 5/1995 Favre ..... B05B 11/026 222/137
5,454,486 A * 10/1995 Mack ..... B05B 11/047 222/105
5,516,006 A * 5/1996 Meshberg ..... B05B 11/1005 222/25
5,620,113 A * 4/1997 Meshberg ..... B05B 11/0059 222/1
5,791,527 A * 8/1998 Giuffredi ..... B05B 11/0056 222/525
5,813,571 A * 9/1998 Gaucher ..... B05B 11/026 222/105
6,126,042 A * 10/2000 Meshberg ..... B05B 11/0013 222/376
7,207,452 B2 * 4/2007 Jourdin ..... B05B 11/1049 222/321.9
7,743,949 B2 * 6/2010 Ramet ..... B05B 11/029 141/23
7,770,755 B2 * 8/2010 Arghyris ..... B05B 11/026 222/144.5
7,780,039 B2 * 8/2010 Criswell ..... B05B 11/1097 222/321.3
8,167,171 B2 * 5/2012 Moretti ..... B05B 11/1047 222/105
8,308,029 B2 * 11/2012 Ki ..... B05B 11/0027 222/321.9
8,397,951 B2 * 3/2013 Moretti ..... B05B 11/1047 222/105
8,459,501 B2 * 6/2013 Moretti ..... B29C 49/18 222/105
8,875,425 B2 * 11/2014 Moretti ..... B05B 11/0038 40/310
9,050,433 B2 * 6/2015 Lambie ..... B05B 11/0067
9,144,813 B2 * 9/2015 Kim ..... B05B 11/0032
9,580,224 B2 * 2/2017 Ziegenfelder ..... B65D 83/0055
9,694,377 B2 * 7/2017 Michaux ..... B05B 11/0038
9,908,130 B2 * 3/2018 Moretti ..... B05B 11/1043
10,052,643 B2 * 8/2018 Moretti ..... B65D 1/023
10,065,203 B2 * 9/2018 Moretti ..... B05B 11/0038
10,376,910 B2 * 8/2019 Okude ..... B05B 11/0008
10,537,907 B2 * 1/2020 Moretti ..... B05B 11/1047
10,688,512 B2 * 6/2020 Moretti ..... B05B 11/0056
10,689,183 B2 * 6/2020 Moretti ..... B05B 11/0056
10,717,098 B2 * 7/2020 Delmon ..... B05B 11/1001
11,485,545 B2 * 11/2022 Okude ..... B05B 11/0054
2004/0065326 A1 * 4/2004 MacMichael ..... A61M 15/009 128/205.23
2004/0076462 A1 * 4/2004 Grandmottet ..... B05B 11/0056 401/55
2005/0218159 A1 * 10/2005 Hoour ..... B65D 77/0486 222/321.7
2007/0164049 A1 * 7/2007 Bonney ..... B05B 11/1095 222/162
2010/0067970 A1 * 3/2010 Ki ..... B05B 11/0038 222/162
2011/0005517 A1 * 1/2011 Boeck ..... B01D 39/2003 128/200.23
2011/0024452 A1 * 2/2011 Moretti ..... B05B 11/1047 222/105
2012/0125948 A1 * 5/2012 Son ..... B05B 11/1047 222/105
2012/0207413 A1 * 8/2012 Moretti ..... B65D 83/0061 264/513
2014/0103068 A1 * 4/2014 Son ..... B65D 3/04 222/105
2015/0210458 A1 7/2015 Ziegenfelder et al.
2022/0152639 A1 * 5/2022 Moretti ..... B65D 33/14
2022/0161987 A1 * 5/2022 Moretti ..... B05B 11/0037
2022/0258191 A1 * 8/2022 Moretti ..... B05B 11/0072
2023/0008418 A1 * 1/2023 Moretti ..... B05B 11/1047
2023/0011490 A1 * 1/2023 Moretti ..... B05B 11/1047

* cited by examiner

FLUID SUBSTANCE DISPENSING DEVICE

FIELD OF THE INVENTION

The present invention relates to a fluid substance dispensing device.

In particular, it relates to a device for dispensing a fluid substance housed inside a deformable bag coupled, in a sealed manner, to a manual dispensing pump, preferably of the hermetic variety.

BACKGROUND ART

Commonly known devices for dispensing fluid substances by means of a manual pump are made entirely of plastic. Therefore the environmental impact thereof is significant.

Furthermore, costs for purchasing and moulding virgin or partially recycled plastic are high, and therefore commonly known devices are expensive. Especially when 'environmental taxes' are applied to the use of plastic.

SUMMARY OF THE INVENTION

The object of the present invention is to provide a device for dispensing a fluid substance which is more environmentally compatible than commonly known devices.

This and other objects are achieved by means of a device produced according to the technical teachings of the claims annexed hereto.

Advantageously, a device for dispensing a fluid substance according to the invention can be less expensive than commonly known devices.

BRIEF DESCRIPTION OF THE FIGURES

Further features and advantages of the innovation will become clearer in the description of a preferred but not exclusive embodiment of the device, illustrated—by way of a non-limiting example—in the drawings annexed hereto, in which.

DETAILED DESCRIPTION OF THE INVENTION

Figure 1:
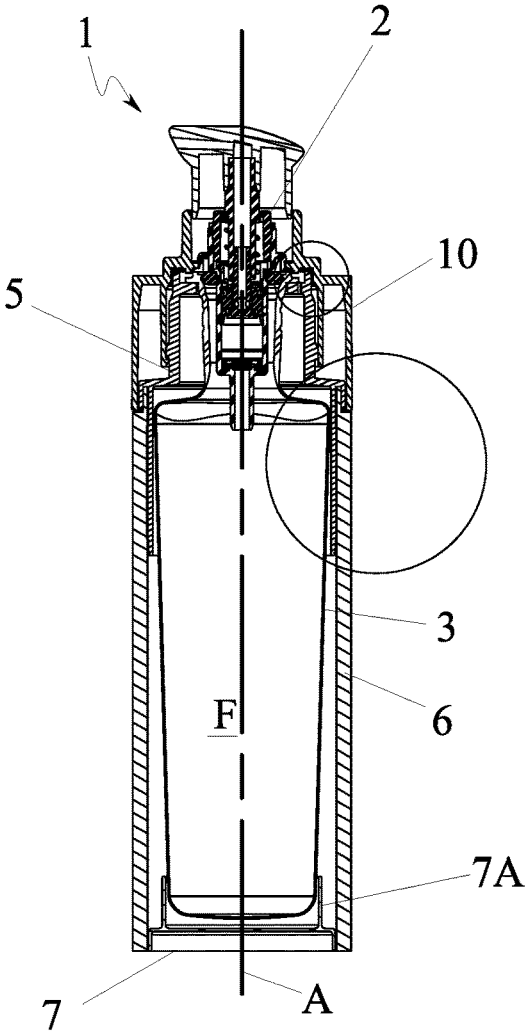
FIG. 1 is an axial section view of the present invention.
Figure 2:
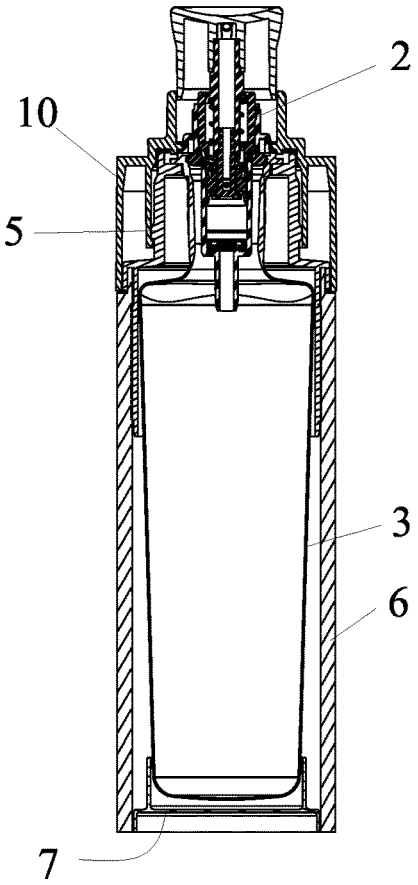
FIG. 2 is a further axial section view of the device in FIG. 1.

With reference to the figures stated, reference number 1 is used to denote, as a whole, a fluid substance dispensing device.

In this wording, a 'fluid substance' means a liquid or cream product designed for cosmetic or medical purposes, such as a hand cream, foundation, body cream, face cream, serum, gel, anti-ageing cream, etc.

The device for dispensing a fluid substance F, housed inside a deformable bag 3, comprises a manually operated pump 2 which is preferably hermetic.

The pump may be of the type commonly known as 'airless', which prevents the entry of external air during the operation thereof. The said pump is coupled, in a sealed manner, to a deformable bag 3.

Therefore, when the fluid substance is dispensed by the pump, a vacuum is created inside the bag 3, which makes the bag deform as the fluid substance is dispensed.

The deformable bag 3 is housed inside a container 4.

The container 4 is formed of a collar 5 made of conventional plastic material coupled to a tubular element 6 formed from a paper or cardboard-based material.

The collar can be formed from a thermoplastic polymer material and can be injection-moulded. Materials suitable for making the collar comprise: PE, PE PCR, HDPE, HDPE PCR, PP, PP PCR, PA, CELLULOSE-BASED PLASTIC, WOOD FIBRE PLASTIC, etc.

The paper-based (or rather cellulose-based) or paperboard-based (or cardboard-based) material can be made of virgin or recycled paper. Advantageously, it can be formed from a single sheet which as been rolled several times to lend it a certain rigidity.

The tubular element can be made of multilayer cardboard and can have a thickness of between 1 mm and 4 mm. It can also be covered with an additional layer of coloured and/or decorated paper or paperboard glued on.

The tubular element has a bottom 7.

The bottom 7 can be an element made as one piece together with the tubular element and as such is also made of paper-based material.

The bottom 7 can also be made as a separate piece from the tubular element, fastened thereto for example by glue or simply by interference-fit with the internal diameters of the tubular element, or the bottom 7 may have reflanging that encloses the edge of the tubular element.

In the event that the bottom is a separate element from the tubular element 6, the said bottom can be made of the same material as the tubular element, of a further cellulose- or cardboard-based material, or of conventional materials such as plastic or aluminium.

In the event that the bottom is made of a material which is different (in recyclability terms) from that of the tubular element 6, the said bottom can be configured to be uncoupled from the tubular element 6 when the device has to be recycled. Regarding this, the bottom 7 may feature a surface or a handgrip (not shown) to enable manual extraction or uncoupling from the tubular element.

Figure 10:
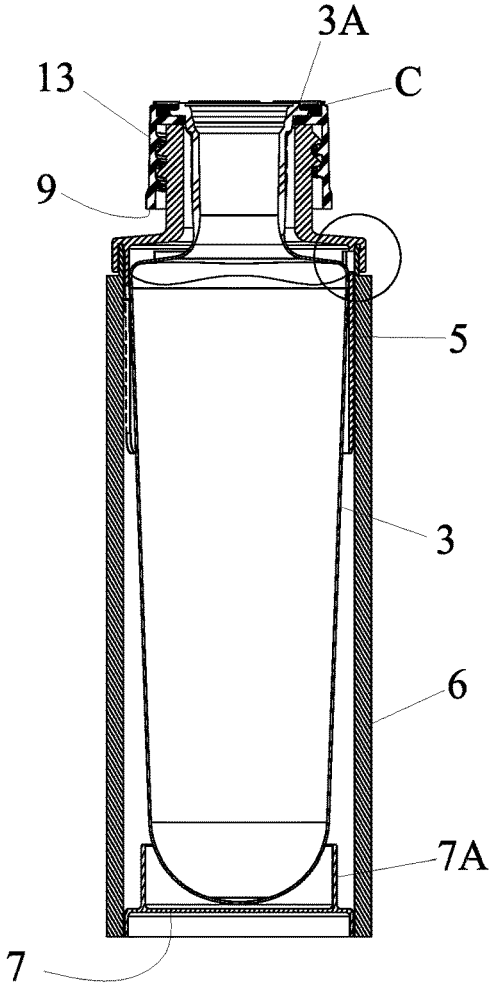
FIG. 10 shows the collar in FIG. 9 coupled to a tubular element, a bottom, and an intermediate pump fastening element.

As can be seen in FIG. 1 or 10, an annular wall 7A can extend from the bottom 7 towards the inside of the tubular element 6, into which wall a free end of the deformable bag 3 is inserted. The wall 7A can be configured to limit the movement of the bag inside the tubular element 6 when the bag is full.

The collar 5 features ribs N made on one of the surfaces thereof that comes into contact with an internal wall of the tubular element 6. Specifically, a plurality of ribs N are present. In this description a plurality of ribs N, means more than two ribs.

The ribs can be made on a tubular skirt that extends from the collar 5 towards the inside of the tubular element.

To improve the seal between the tubular element and the collar, the skirt 5G can extend to a height of between ⅛ and ¼ of the tubular element 6.

The ribs N ensure a perfect fastening between the tubular element and the collar. In practice, the ribs N are impressed into the cardboard (during the insertion of the collar into the tubular element), improving the fastening between the collar and the tubular element and torsionally coupling the cardboard and the said collar.

The ribs may be parallel with respect to an axis A of the tubular element 6, as shown in FIGS. 5 to 8 for example.

Figure 9:
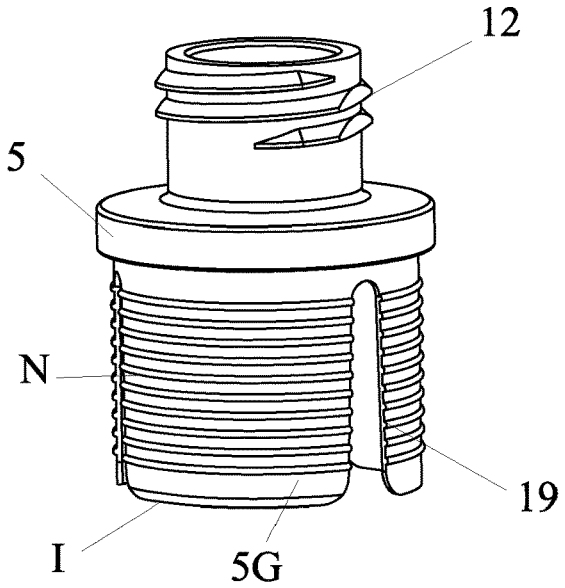
FIG. 9 is a perspective view of a further variant of the collar in FIG. 5.

The ribs N can also be inclined with respect to an axis A of the tubular element (as shown in FIG. 9 for example) or, optionally, orthogonal or with a screw configuration.

Furthermore, slots 19 can be featured which improve the deformability of the skirt 5G, thereby facilitating the insertion thereof into the tubular element.

Slots 19 may be present even if the plurality of ribs N are parallel to an axis A of the tubular element 6.

For example, at least two slots 19 may be formed on the tubular element 6, possibly on its skirt 5G.

On the skirt 5G, at one of the free ends thereof, a positioning element I can be featured which facilitates the centring with the tubular element.

Figure 4:
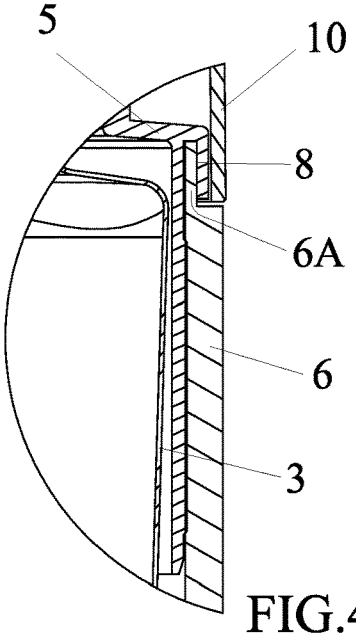
FIG. 4 is an enlarged view of the area enclosed within the large circle in FIG. 1.
Figure 12:
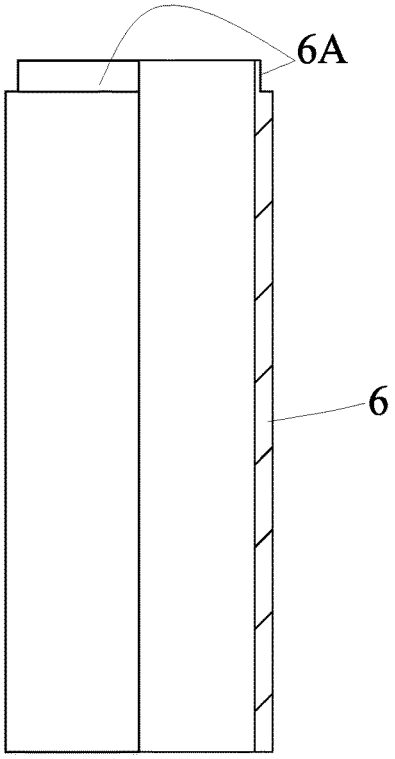
FIG. 12 shows a partially sectioned side view of a tubular element of the device in FIGS. 1 and 10.

The tubular element 6 can feature a sunken area 6A which fits into an annular groove 8 made in the collar 5. The sunken area is clearly visible in FIG. 12, while the coupling of this sunken area is shown in detail in both FIG. 4 and FIG. 11.

The tubular element can also not feature the sunken area 6A and therefore can be equipped with a wall with an essentially constant thickness. Also in this case, however, the groove 8 into which the end of the tubular element fits may be present.

Figure 11:
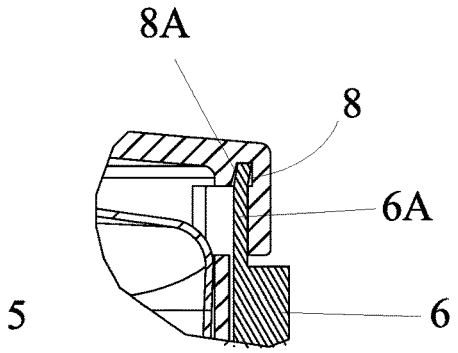
FIG. 11 shows an enlarged detail of the part circled in FIG. 10.

In FIG. 11, it can be seen that the groove can feature an inclined surface 8A which deforms one end of the sunken area 6A, forming an undercut, when the tubular element 6 is coupled to the collar 5.

In this way, the coupling can be even more solid.

It must be said that the presence of the inclined surface can be envisaged in both the solution in FIG. 9 and in those in FIG. 5-7 or 8.

Figure 5:
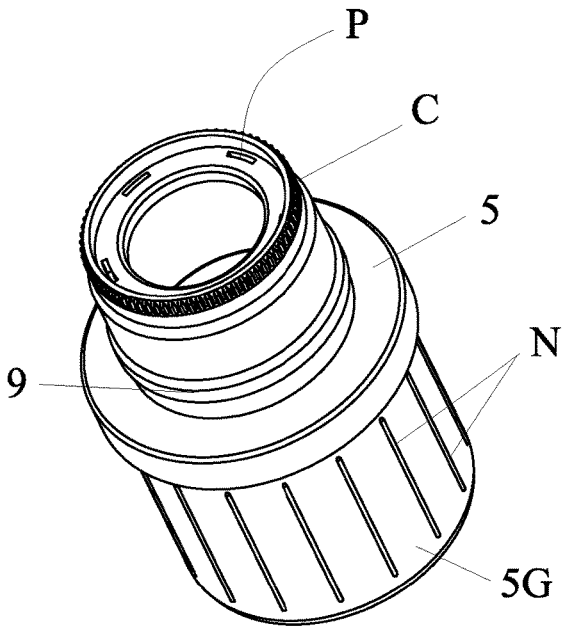
FIG. 5 is a perspective view of a collar of the device in FIG. 1.
Figure 6:
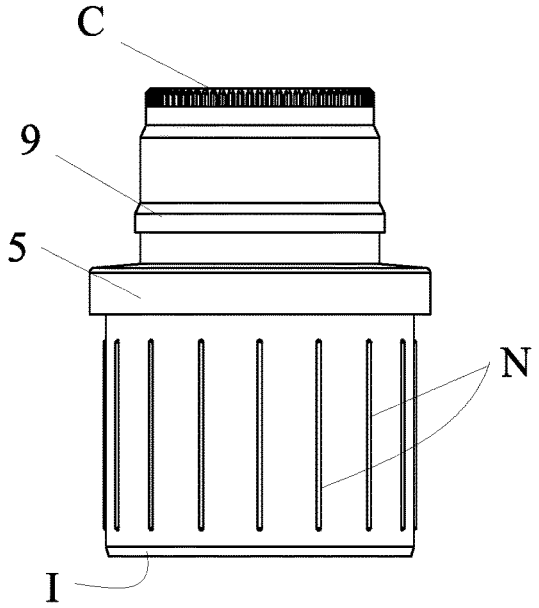
FIG. 6 is a side view of the collar in FIG. 5.
Figure 7:
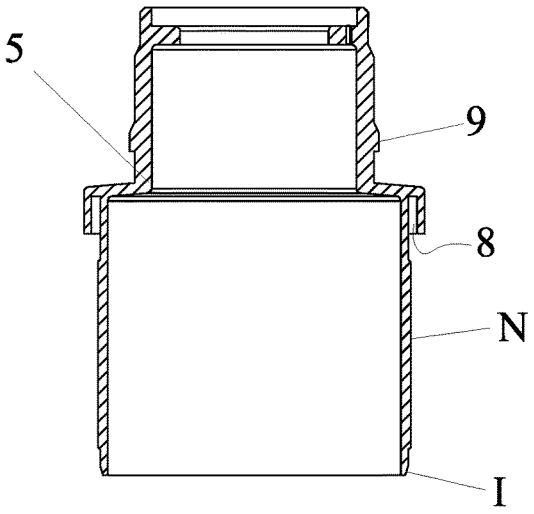
FIG. 7 is a section view of the collar in FIG. 5.

A collar such as that shown in FIG. 5 can feature at least one undercut 9, for example with a tooth configuration, onto which an element 10 for locking the pump to the collar 5 is snap-coupled.

Figure 3:
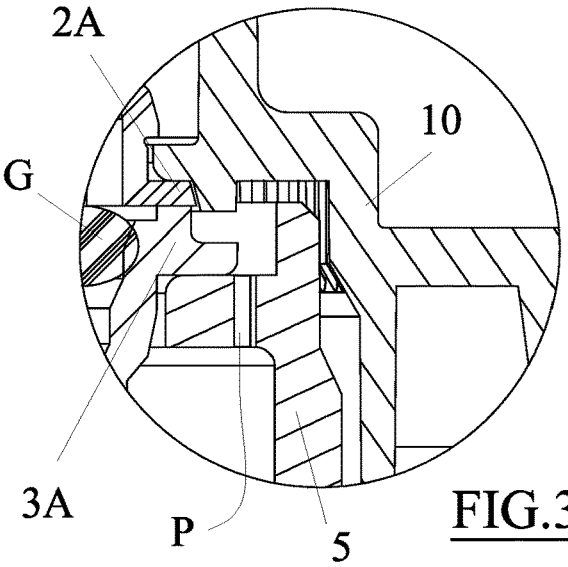
FIG. 3 is an enlarged view of the area enclosed within the small circle in FIG. 1.

In this case, the pump 2 can feature (see FIG. 3) a first flange 2A and the deformable bag can feature a second flange 3A, both of which are placed in a mutual arrangement and sandwiched between the collar 5 and the locking element 10.

A sealing gasket G can be interposed between the pump 2 and the bag 3.

Figure 8:
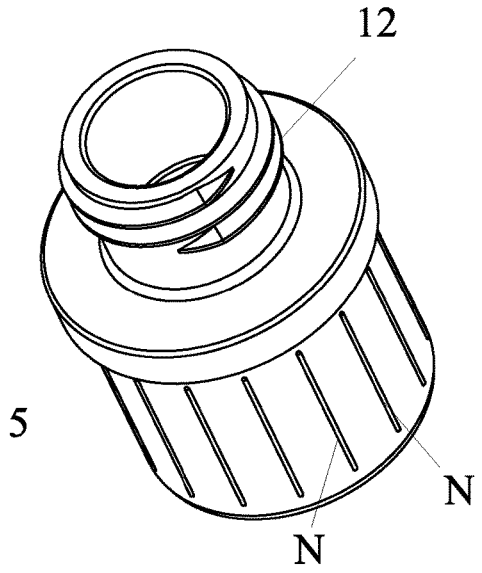
FIG. 8 is a perspective view of a variant of the collar in FIG. 5.

As can be seen in FIG. 8, the collar 5 can feature a thread 12.

An intermediate element 13 can be screwed onto the thread 12, as shown in FIG. 10.

Although FIG. 10 shows the collar in FIG. 9 coupled to the tube, the operation of the thread system is perfectly identical for the collar in both FIG. 8 and FIG. 9.

Essentially, a flange 3A of the deformable bag 3 can be placed on the element 13, and the intermediate element 13 can feature an undercut 9 (which in this case is on the free edge thereof) for snap-coupling the element 10 locking the pump 2, in a similar way to that described for FIG. 1.

It should be noted that, instead of the thread, the collar in FIG. 9 may feature a hooking system, like that of the collar in FIG. 5. In this case, therefore, the intermediate element 13 is not necessary.

To end the description, it should be noted that the collar 5 can feature an air passageway P in communication with the interior of the tubular element 2. Furthermore, the end of the collar 5 and/or of the intermediate element 13 may feature a cog C that allows the passage of air into the tubular element 2.

It is clear how the solution shown is environmentally compatible, as a cellulose-based material is used for the construction of a major, extensive part of the dispensing device.

For the same reasons, the device according to the invention may be produced more cheaply than a conventional plastic bottle, especially in places where an 'environmental tax' is applied to the use of plastic.

It should also be noted that by firmly rotating or pulling the collar and the tubular element, the two elements can be separated, for a more effective waste sorting.

It goes without saying that, from the same viewpoint, the presence of a bottom 7 which is also made of cardboard or a cellulose-based material is very advantageous.

Various embodiments of the innovation have been disclosed herein, but further embodiments may also be conceived using the same innovative concept.

The invention claimed is:

1. A dispensing device of a fluid substance (F), comprising a manually operated pump (2) coupled to a deformable bag (3), the deformable bag being housed inside a container (4), characterized in that the container is formed by a collar (5) made of plastic material coupled to a tubular element (6) formed in a material comprising paper or cardboard, the tubular element providing a bottom (7), the collar (5) providing a plurality of ribs (N) made on a contact surface of the collar (5) with an internal wall of the tubular element (6), the plurality of ribs (N) being parallel with respect to an axis (A) of the tubular element, said plurality of ribs being impressed into the material of the tubular element to facilitate fastening between the collar (5) and the tubular element (6).

2. The dispensing device according to claim 1, wherein at least two slots (19) are formed on the collar (5) to improve its deformability, thereby facilitating the insertion of the collar (5) into the tubular element (6).

3. The dispensing device according to claim 1, in which the tubular element (6) has an area (6A) which is inserted in an annular groove (8) obtained in the collar (5).

4. The dispensing device according to claim 1, in which the annular groove (8) has an inclined plane (8A) which undercuts one end of the area (6A) when the tubular element (6) is coupled to the collar (5).

5. The dispensing device according to claim 1, wherein an annular wall (7A) extends from the bottom (7) towards an inside of the tubular element (6) wherein a free end of the deformable bag (3) is inserted into the annular wall so as to limit the movement of the bag inside the tubular element (6) when the bag is full.

6. The dispensing device according to claim 1, wherein the bottom (7) is made of material comprising paper or cardboard.

7. The dispensing device according to claim 1, wherein the collar (5) provides at least one undercut (9) to which a locking element (10) of the pump is snapped onto the collar (5).

8. The dispensing device according to claim 7, in which the pump (2) has a first flange (2A) and the deformable bag has a second flange (3A) which are mutually placed and sandwiched between the collar (5) and the locking element (10).

9. The dispensing device according to claim 1, wherein the collar (5) has a thread (12) on which an intermediate element (13) is screwed, a flange (3A) of the deformable bag (3) resting on the intermediate element (13), the intermediate element (13) having an undercut (9) for the snap coupling of the locking element (10) of the pump (2).

10. The dispensing device according to claim 1, in which the collar (5) provides an air passage (P) in communication with the interior of the tubular element (2), and/or in which one end of the collar (5) has a toothed crown (C) which allows the passage of air inside the tubular element (2).

* * * * *